US008469319B2

(12) United States Patent
Kiss, Jr. et al.

(10) Patent No.: US 8,469,319 B2
(45) Date of Patent: Jun. 25, 2013

(54) RAILWAY SENSOR COMMUNICATION SYSTEM AND METHOD

(75) Inventors: James Michael Kiss, Jr., Melbourne, FL (US); Eric Bruce Moore, Melbourne, FL (US); Dirk Uebe, Mannheim (DE)

(73) Assignee: General Electric Company, Schenectady, NY (US)

( * ) Notice: Subject to any disclaimer, the term of this patent is extended or adjusted under 35 U.S.C. 154(b) by 41 days.

(21) Appl. No.: 12/852,073

(22) Filed: Aug. 6, 2010

(65) Prior Publication Data

US 2011/0133038 A1 Jun. 9, 2011

Related U.S. Application Data

(63) Continuation-in-part of application No. PCT/US2009/033327, filed on Feb. 6, 2009.

(60) Provisional application No. 61/027,082, filed on Feb. 8, 2008.

(51) Int. Cl.
*B61L 1/02* (2006.01)

(52) U.S. Cl.
USPC ..... 246/125; 246/126

(58) Field of Classification Search
USPC ..... 246/122 R, 124, 126, 123, 125, 127, 246/129, 128, 130
See application file for complete search history.

(56) References Cited

U.S. PATENT DOCUMENTS

| | | | | |
|---|---|---|---|---|
| 5,699,986 | A * | 12/1997 | Welk | 246/125 |
| 5,864,304 | A * | 1/1999 | Gerszberg et al. | 340/903 |
| 5,890,682 | A * | 4/1999 | Welk | 246/125 |
| 6,241,197 | B1 * | 6/2001 | Harland | 246/293 |
| 6,386,486 | B1 * | 5/2002 | Speranza | 246/293 |
| 6,411,896 | B1 * | 6/2002 | Shuman et al. | 701/431 |
| 7,075,427 | B1 * | 7/2006 | Pace et al. | 340/539.22 |
| 7,315,770 | B2 * | 1/2008 | Wade et al. | 701/19 |
| 7,575,202 | B2 * | 8/2009 | Sharkey et al. | 246/293 |
| 7,624,952 | B1 * | 12/2009 | Bartek | 246/124 |
| 7,832,691 | B2 * | 11/2010 | Reibeling et al. | 246/125 |
| 7,840,338 | B2 * | 11/2010 | Paolacci | 701/117 |
| 8,054,197 | B1 * | 11/2011 | Martin et al. | 340/815.44 |
| 2001/0022332 | A1 * | 9/2001 | Harland | 246/122 R |
| 2008/0237406 | A1 * | 10/2008 | Saito et al. | 246/124 |
| 2011/0133038 | A1 * | 6/2011 | Kiss et al. | 246/126 |

FOREIGN PATENT DOCUMENTS

EP 1731397 A1 * 12/2006

* cited by examiner

*Primary Examiner* — Jason C Smith
(74) *Attorney, Agent, or Firm* — GE Global Patent Operation; John A. Kramer

(57) ABSTRACT

An approach annunciator for a railway includes at least one sensor for sensing a vehicle traveling along the railway, a control device adapted to receive a first message from the sensor and to create a second message, and a transmitting module adapted to send the second message created by the control device. The control device is adapted to operate the transmitting module in one of a plurality of modes including an energy saving mode and an operation mode.

23 Claims, 6 Drawing Sheets

RAILWAY SENSOR COMMUNICATION SYSTEM AND METHOD

This application is a continuation-in-part of International Application No. PCT/US2009/033327, filed Feb. 6, 2009, which claims priority to U.S. Provisional Application No. 61/027,082, filed Feb. 8, 2008, each of which are incorporated by reference herein in their entireties.

BACKGROUND OF THE INVENTION

Embodiments of the invention relate to sensor communications for railways, and, more particularly, to train approach annunciators for rail systems and level crossing protection systems.

Operators of railway networks, for example the Deutsche Bahn A G, generally use train-controlled or signal-controlled level crossing protection systems, e.g., a barrier or crossing gate for road traffic, or a combination of both. These level crossing protection systems may have different security levels, for example US and Fu systems for train-controlled systems and Hp systems for signal-controlled systems. The term "level crossing" (also called a railroad crossing, road through railroad, railway crossing, train crossing, or grade crossing) refers to a crossing on one level (at-grade intersection)—without recourse to a bridge or tunnel—of a railway line by a road, path, or another railroad.

For example, European Patent Application EP 1 187 750 A1 discloses a level crossing protection system having switch parts for controlling at least the road traffic, and a track mounted sensor arrangement for detecting rail vehicles traveling past and at least indirectly controlling the switch parts. The system also includes a decentralized power supply device for operating the sensor arrangement for switching on the railway crossing safety system and a radio link from these sensor arrangements to the railway crossing. This level crossing protection system may only be used where no more than eighty trains per day are passing.

If main signals are available for a track of a railway, the main signals are used to protect the level crossing. An activation and deactivation of the level crossing protection system is effected in the Hp monitoring mode from an interlocking. (An interlocking is an arrangement of signal apparatus that prevents conflicting movements through an arrangement of tracks such as junctions or crossings.) The activation occurs automatically from the road logic system. To achieve a timely closure (especially in systems using half barriers, but also when full-barriers are used), electric approach annunciators are desired, to avoid excessive and possibly inappropriate closure times for the road traffic. Similar devices are used in other parts of railways, for example in rail yards, to detect the presence of vehicles and relay information concerning vehicle approach to equipment further down the railway line.

Generally, an approach annunciation is realized with a vehicle sensor in or near the track and with a cable connecting the vehicle sensor to an interlocking, or to a level crossing and from the level crossing to the interlocking. The vehicle sensor recognizes a passing of a train in the direction of a level crossing protection system, and a notification signal is generated and transmitted to the interlocking. In the interlocking, the received notification signal is processed. If the vehicle sensor (or other sensing device or element) is close to the theoretical approach annunciator point, the notification signal may be used directly for the approach annunciation. The theoretical approach annunciator point is the distance from the level crossing where, if a train is detected and a notification signal immediately generated and transmitted to an interlocking, there would be sufficient time to activate a level crossing protection system (barrier, light signal, or signal installation at the level crossing) before arrival of the train, at an expected maximum speed of the train, and without activating the level crossing protection system too far in advance of the train's arrival to pose an inconvenience for those crossing the railway at the level crossing. The theoretical approach annunciator point may be calculated based on the expected maximum speed of the train (e.g. speed limit), the time required to activate the level crossing system, the time delay to generate, transmit, receive, and process a notification signal (assumed to be a short time), and a safety margin (typically, it is desired for the level crossing protection system to be fully activated in advance of the train arriving at the level crossing). In the case that the location of the vehicle sensor or other sensor or sensing element in not optimal, this may be optimized by a delay device for simulating an optimal approach annunciation point that is then used for the calculation of the time of the passage of the train at the level crossing protection system. In both cases, cable conductors to the interlocking or a neighboring interlocking must be available for transmitting the approach annunciation of the train. In this case, a detector or a sensor (rail switch, induction loop, or axle counter) and a cable connection to the interlocking is or are required. If no free conductors are available, a new cable must be installed with all the costly works and accompanying activities of construction work for laying cable.

In particular, in the case of an increasing distance between the approach annunciation point and the level crossing, a conventional wire bound solution is costly and lacks flexibility to quickly adapt to changing requirements. Usually, the necessary cable routing and civil engineer work require lengthy planning and approval processes before the construction work can start. The costs of construction work can only be roughly estimated prior to the actual construction, meaning that an additional budget is required in most cases.

BRIEF DESCRIPTION OF THE INVENTION

Embodiments of the invention provide a vehicle sensor communications system for a railway that minimizes power consumption.

As used herein, the term "approach annunciator" is used generally to mean a device that is used to transmit a message to a remote device, in response to the presence of a vehicle at a particular location in a railway. While the invention will be described in the context of an annunciator for a railway crossing, it will be understood that the principles described here are equally applicable to other kinds of railway systems which use vehicle sensors that must communicate to downline (i.e., remote) equipment, such as signals, control centers, and the like. For example, vehicle sensors may be found in rail yards where cars and locomotives are coupled to make up trains.

According to one aspect of the invention, an approach annunciator includes at least one sensing device for sensing a vehicle traveling along a railway, a control device, and a transmitting module. The control device is adapted to receive a first message from the at least one sensing device and to create a second message. The transmitting module is adapted to send the second message created by the control device, and the control module is adapted to adjust the transmitting module in one of a plurality of modes, wherein the modes include an energy saving mode and an operation mode. The second message that is sent may be a "train approaching" (more generally, vehicle approaching) message.

According to another aspect of the invention, an approach annunciator provides an energy-optimized system. For example, the approach annunciator may generate and send a second message more than 9000 times per day. Therefore, the number of trains that may be annunciated by the approach annunciator per day is determined only by the capacity of the railway infrastructure, e.g., the number of vehicles that are allowed to pass the railway/track.

The creation of the second message may be in a simple repetition or forwarding of the first message. The second message may be created from the first message.

According to another aspect of the invention, in an energy saving mode, the transmitting module may be the only portion of the system set to the energy saving mode, wherein in the energy saving mode the transmitting module consumes much less energy than in the operation mode. The control module and the sensing system remain in operation while the transmitting module is in the energy saving mode, so that the sensing device for detecting a vehicle traveling along the rail is continuously monitored. This is especially important where the sensor being monitored is part of failsafe, safety-critical, or vital operational equipment. As soon as a vehicle is detected, the transmitting module may be adjusted from the energy saving mode to the operation mode, sending the message, and may subsequently be adjusted into the energy saving mode. Therefore, the transmitting module in this embodiment consumes higher levels of energy only during the sending of the message. For example, a message of the sensing device may comprise a single signal impulse. The transmitting module may in a further embodiment also include a receiving device.

According to another aspect, the transmitting module may consume less energy in the energy saving mode than in the operation mode, in particular less than approximately 50%, and more typically less than approximately 25% of the energy in the operation mode. In a further embodiment, when the transmitting module is in the energy saving mode, the transmitting module consumes less than approximately 10%, in particular less than approximately 5%, of the energy in the operation mode.

It may be provided that the transmitting module is adapted to send the second message in the operation mode. In particular, it may be provided that the second message is only sent in the operation mode so that in the energy saving mode no second message is sent.

The transmitting module may be adapted to send the second message in the energy saving mode with a lower power and/or with a lower repetition rate than a second message sent in the operation mode. Therefore, in this embodiment, a second message sent in the operation mode is sent with normal power or without reduction of the power. Sending with less power or a lower repeating rate may also save energy, e.g., instead of ten repetitions of the sent message, it is only repeated five times.

The approach annunciator may be configured to transmit the second message only when a critical sense event occurs, and to suppress transmission relating to subsequent events that are not relevant to the condition being monitored.

The energy saving mode may be a sleep mode. In a sleep mode, for example, it may be the case that the only functions/portions of the transmitting module that are provided with energy are those that allow for a fast return of the transmitting module to its normal mode of operation (or to the energy saving mode). The rest of the transmitting module, e.g., an amplifier circuit, is deactivated. For example, the sleeping mode may be optimized to allow a faster switch into the operation mode than in the case of the transmitting module switching from a power down state (completely switched off) to the operation mode.

In one embodiment, in the sleep mode the transmitting module consumes approximately 1% to approximately 50%, in particular approximately 1% to approximately 25%, of the energy of the operation mode of the transmitting module. In a further embodiment, the transmitting module consumes in the sleep mode between approximately 1% and approximately 10%, in particular between approximately 1% and approximately 5%, of the energy in the operation mode.

In a further embodiment, when in the sleep mode, a high frequency oscillator for a modulation of the second message may be turned off. Thus, the energy of the operation of the high frequency oscillator is saved.

The transmitting module may be switched off in the energy saving mode. In the case of a completely switched off transmitting module, the transmitting module is not provided with current and thus does not consume any energy. In this case, for putting the transmitting module into the energy saving mode, its energy supply is adapted to be switched off by the control device. For example, the energy supply may be switched on and off using a transistor or a relay that is controlled by the control device.

The sensing device may comprise an evaluation circuit, a sensor control, and/or at least one sensor, wherein the evaluation circuit is adapted to detect a signal of the at least one sensor and to create the first message for the control device. In this case, the evaluation circuit may be adapted to determine and to transmit in the first message to the control device the direction and/or the velocity of the vehicle traveling along the rail. For example, an axle-counting sensor (or several sensors arranged consecutively at the rail) may be used for such a velocity and/or direction detection.

The control device may be adapted to create the second message upon the sensing device detecting a vehicle traveling along the rail, to adjust the transmitting module to the operation mode, and to send the second message with the transmitting module. In one embodiment, the transmitting module is only switched on in case of sending of the second message. Additionally, in another embodiment, the control device may be adapted to create the second message depending on the direction and/or the velocity of the vehicle traveling along the railway, to adjust the transmitting module to the operation mode, and to send the second message with the transmitting module. In the case where the approach annunciator is located before a level crossing, e.g., only a second message may be created and sent, if the vehicle is driving in the direction of the level crossing. In a further embodiment, the second message is created in dependence of the velocity, e.g., if the vehicle has a low velocity, the second message is sent delayed, so that, in case a barrier is closed as a result of the second message or a loud speaker message should be started, this is not done too early.

In a further embodiment, the control device is adapted to create a status message as a second message, to adjust the transmitting module to the operation mode, and to send the status message with the transmitting module in predetermined regular time intervals. Therefore, a control center monitoring the approach annunciator may detect at any time that the approach annunciator has failed. Further, this reduces the rate/frequency of approach annunciator service, if a service technician is sent to the site only when the approach annunciator fails. The status message may also include information about the status of the battery supplying the approach annunciator, so that the battery may be changed timely. The status message may be sent every 60 seconds or in another interval. In one embodiment the time interval is between 1 and 60 seconds. The control device may be adapted to adjust the transmitting module to the energy saving mode after sending the status message or the second message. Then, the transmitting module is only in the operation mode during the sending of the second message.

In another embodiment, the approach annunciator system includes a battery. The approach annunciator is adapted/configured so that the battery provides the sensing device, the control device, and/or the transmitting module with energy. In this case, the sensing device, the control device, and/or the transmitting module may be configured to run off the same voltage level, for example with 12V DC. Then, multiple transformers are not required. The approach annunciator system may comprise a photovoltaic device for charging the battery. Therefore, standalone operation of the approach annunciator is possible, and no construction work is required for running power lines to the approach annunciator for staring operation thereof.

Although, in a further embodiment, the approach annunciator is adapted to charge the battery with energy from the low voltage grid and/or the catenary of a railway. Therefore, the catenary of a railway line or a 220V low voltage grid may be used for securing the energy supply.

In one embodiment, the transmitting module is configured for wireless transmission of the second message, i.e., the second message is transmitted using electromagnetic waves. Hence, a radio link between the approach annunciator and the site that has to receive the message is enabled. Therefore, for data transmission, it is not necessary to install data cables, which can be expensive.

The approach annunciator may be remotely configurable. For example, the approach annunciator may be configured for interfacing with a GSM-R network, a GSM network, a UMTS network, a GPRS network, and/or another network, for communications between the approach annunciator and another entity, e.g., a control center.

Further, in another embodiment, a train approach center may be adapted to set the mode of the transmitting module of the approach annunciator. Therefore, in this embodiment, the approach annunciator receives a message about the mode into which the transmitting module is to be set, and adjusts the transmitting module in the respective mode, e.g., the energy saving mode or the operation mode.

In one embodiment, the approach annunciator system comprises at least one signal repeating unit with a transmitting and receiving module, wherein the at least one signal repeating unit is adapted to receive a second message sent via electromagnetic waves (e.g., from an approach annunciator) and then to resend the received second message using electromagnetic waves. The signal repeating unit may resend the received second message to a train approach center, which is adapted to receive the transmitted message.

For example, according to a further embodiment, a train approach annunciator system, e.g., for a single-track in a single direction mode, may comprise a train approach center, an approach annunciator, and a sensing device. In case of a single track in a dual direction mode, the train approach annunciator system may comprise a train approach center, two approach annunciators, and for each approach annunciator a sensing device. In case of a double track in a single direction mode, the train approach annunciator system may comprise a train approach center, an approach annunciator, and for each track a sensing device. In case of a double track in a dual direction mode, the train approach annunciator system may comprise a train approach center, two approach annunciators, and for each approach annunciator two sensing devices, wherein one sensing device is assigned to one of both tracks.

The approach annunciator, the train approach center, and/or the signal repeating unit may be remotely configurable. For example a GSM-R, a GSM, a UMTS and/or a GPRS network may therefore be used, in a manner similar to as described above.

The approach annunciator may be part of a level crossing protection system with at least one operating element for controlling road and/or pedestrian traffic at a level crossing. The operating element may be a signal installation and/or a controllable gate or other barrier. The train approach center may be adapted to receive a status report of the at least one operating element. This status report may signify that the barrier is open or closed and if the signal installation is activated or out of order. In a further embodiment, the status report may only contain the information if the level crossing is protected or not protected.

In one embodiment of the level crossing protection system, the approach annunciator is adapted to control a vehicle control system of the vehicle. In particular, the control system is positioned close to or at the rail between the sensing device and the level crossing. An automatic control system may be provided, that may change the velocity of the vehicle, and in particular may stop the vehicle. The vehicle control system may be an automated train protection system and/or at least one supervision signal installation. A supervision signal installation may signal to a driver of the vehicle if the level crossing is protected or not protected, so that the driver has enough time to stop the vehicle. The automated train protection may be in particular a point-wise train protection that initiates a stop of the vehicle.

In another embodiment, the train approach center is adapted to create from the status report a third message and to send the third message to the approach annunciator, wherein the approach annunciator controls the vehicle control system depending on the third message. The train approach center may create, for example, a message that the level crossing is not protected, or that the barrier is not closed. Then, the approach annunciator may set the protection system for the vehicle such that a stop of the vehicle is caused. The stop may be take place automatically if an automated train protection system is used, and/or may be carried out manually if the driver of the vehicle sees the respective signal at the supervision signal installation.

In another embodiment, a method is provided for annunciating an approaching vehicle on a railway. The method is carried out in conjunction with an approach annunciator that comprises at least one sensing device for detecting of a vehicle traveling along the railway, a control device, and a transmitting module. The method comprises receiving a first message of the at least one sensing device by the control device. The method further comprises creating a second message by the control device, and sending/transmitting the second message by the transmitting module. The transmitting device is operated in one of a plurality of modes comprising an energy saving mode and an operation mode.

The transmitting module may be changed to the operation mode before the sending of the second message, and subsequently changed to the energy saving mode after the sending of the second message. It may be provided that in the energy saving mode less energy is consumed by the transmitting module than in the operation mode, in particular less than approximately 5% of the energy in the operation mode. Further, it may be provided that the second message is sent only in the operation mode. Alternatively, it may be provided that the second message is sent in the energy saving mode with less power and/or less repetitions. The energy saving mode may be a sleep mode, which consumes between approximately 1% and approximately 5% of the energy consumed in the operation mode. In the sleep mode a high frequency oscillator for signal modulation is turned off. The transmitting module may be switched off in sleep mode, in particular by the control device.

BRIEF DESCRIPTION OF THE DRAWINGS

Further features and advantages of the invention are described in the following description, in which several embodiments of the invention are explained with respect to schematic drawings in detail. Therein.

DETAILED DESCRIPTION OF THE INVENTION

Figure 1:
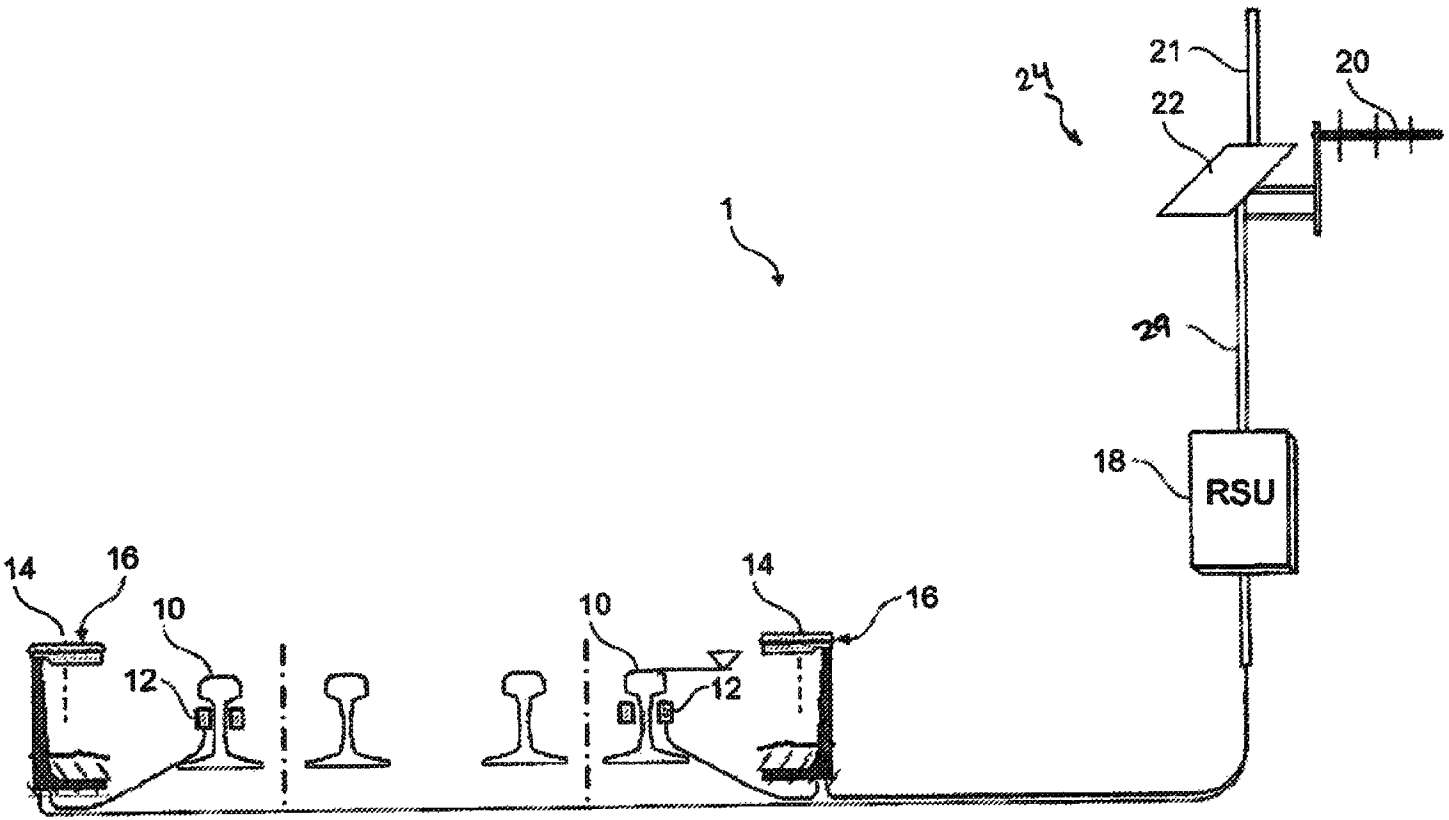
FIG. 1 shows a schematic view of an approach annunciator.

FIG. 1 shows an approach annunciator 1 according to an embodiment of the invention. The approach annunciator 1 is deployed at or near a double track comprising two pairs of rails 10. (For example, one pair of rails may be for train travel in one direction, and the other pair for train travel in the other direction, or both pairs may be for the travel of two trains in the same direction.) A respective railway vehicle sensor 12 (for train recognition) is mounted to one rail 10 in each pair of rails. The sensor may be, for example, a double rail switch that is clamped or screw mounted to the rail. For example, double rail switches of the axle counting system of the General Electric Company (WDD wheel detector) may be used. The rail sensors 12 are electrically connected to a respective sensor control 14 that may be installed in a housing 16. Signals are transmitted from the sensor control 14 in the housing 16 via a cable to a switching cabinet 18 ("RSU") and are evaluated by a control device 26 and/or an evaluation circuit 27 (see, e.g., FIG. 5). The control device generates a "train approaching" message (or, more generally, a "vehicle approaching" message), which is wirelessly transmitted by a transmitting module 24. It is noted that the content of the message (also referred to as a "first message") need not contain any specific data and may be a simple change of signal or state. The transmitting module 24 may be a radio device that includes transmitting circuitry and an antenna 20.

Depending on its particular configuration, the double rail switch (sensor 12) may include two sensors with two different frequencies for recognizing the direction of travel of a train, and may be configured to automatically detect only trains that are driving in the direction of the level crossing. This way, the need for an inoperative monitoring contact is unnecessary for trains that move away from the level crossing. This construction is adapted to calculate, from a time difference of the interaction of both sensors, the velocity or speed of the train and consequently an approach time. Therefore, it is possible to implement an approach time compensation as an additional feature for trains with different speeds. Instead of a double rail switch, the control device or evaluation circuit may calculate the direction and the speed of a train driving on the rail and may forward it to the control device.

Figure 5:
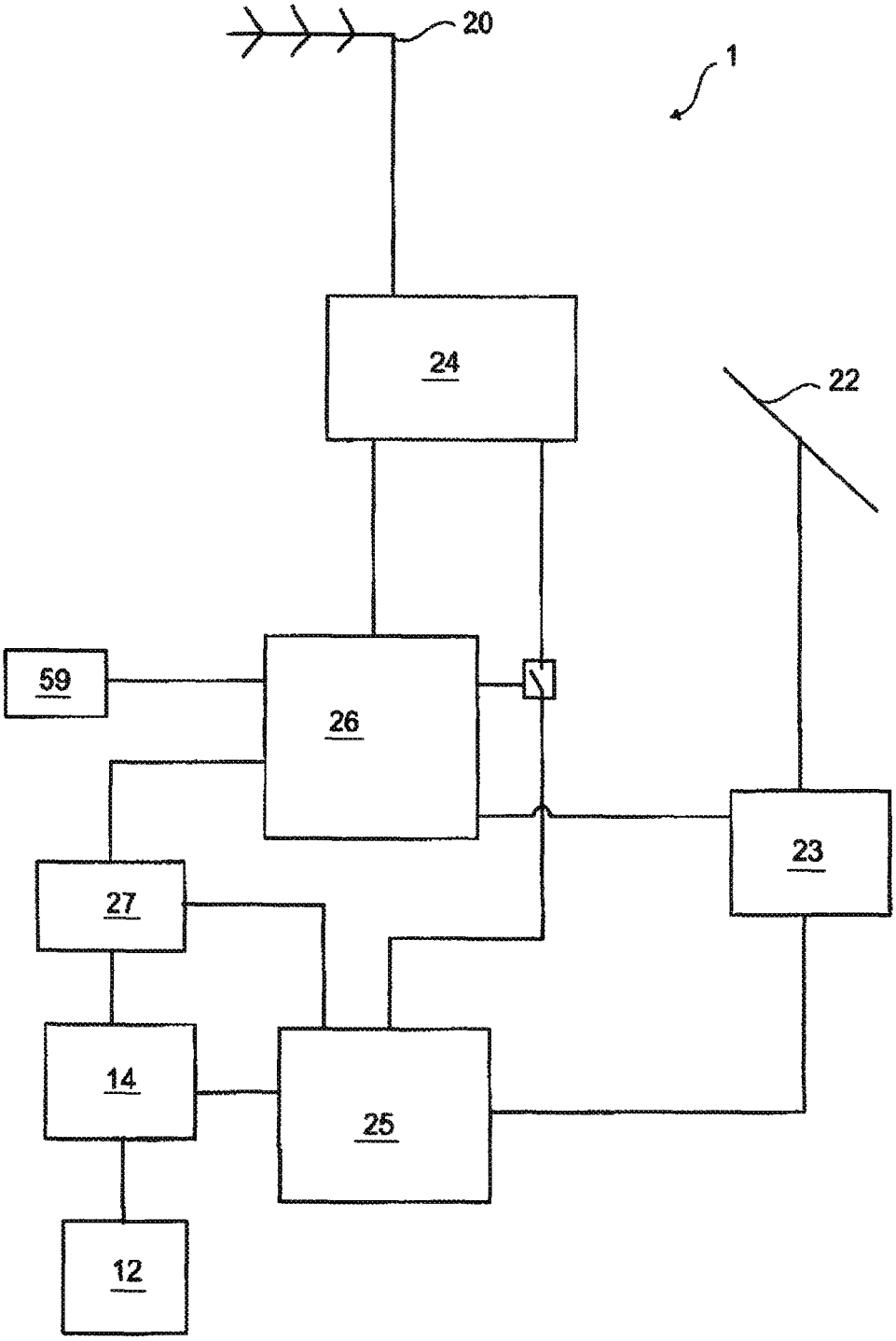
FIG. 5 shows a schematic block diagram of an approach annunciator.

As shown in FIG. 5, in an embodiment, the power supply for the approach annunciator 1 comprises a battery 25. A battery charger (or a battery charge controller) 23 is supplied by different sources depending on the site. For example, in one embodiment, a photovoltaic module 22 supplies electricity to the battery charger 23. Alternatively, in another embodiment, an outdoor line-voltage transformer from the traction power supply (e.g., traction power at 15 kV, 16.7 Hz) or energy supply from a low voltage grid (e.g., 230 VAC) is used. The low voltage grid or the supply via the traction power supply may also be used directly for the energy supply of the approach annunciator 1.

The photovoltaic module 22 is, in case of a power supply via solar energy, mounted on a mast 29. The mast may be, for example, fabricated of fiberglass-reinforced plastic. The photovoltaic module 22 is mounted therefore in the upper portion of the mast 29. A substantial height, for example 5 meters (16.4 ft.), of the mast 29 reduces the risk of theft of the photovoltaic module 22. Further, an antenna 20 is mounted onto the mast 29, wherein the antenna may be used for transmitting messages over radio/electromagnetic waves. Additionally, a lightning rod 21 is mounted on the tip of the mast 29, such that the approach annunciator may comply with a lighting protection class II according to the standard DIN EN 62305. Cables to the antenna 20 or from the photovoltaic module 22 to the battery charger 23 may be routed inside the mast 29 and may be guided in a protection tube (not shown) in the ground directly from the bottom into the switching cabinet 18. This further increases protection against vandalism damage.

The battery 25 may be installed in the switching cabinet 18 and, in a specific embodiment, is maintenance free. Thus, for example, each train approach sensor may be designed for an autonomous period of eight days, so that a high availability of a train approach detector, for example 0.9997, is achieved.

Figure 2:
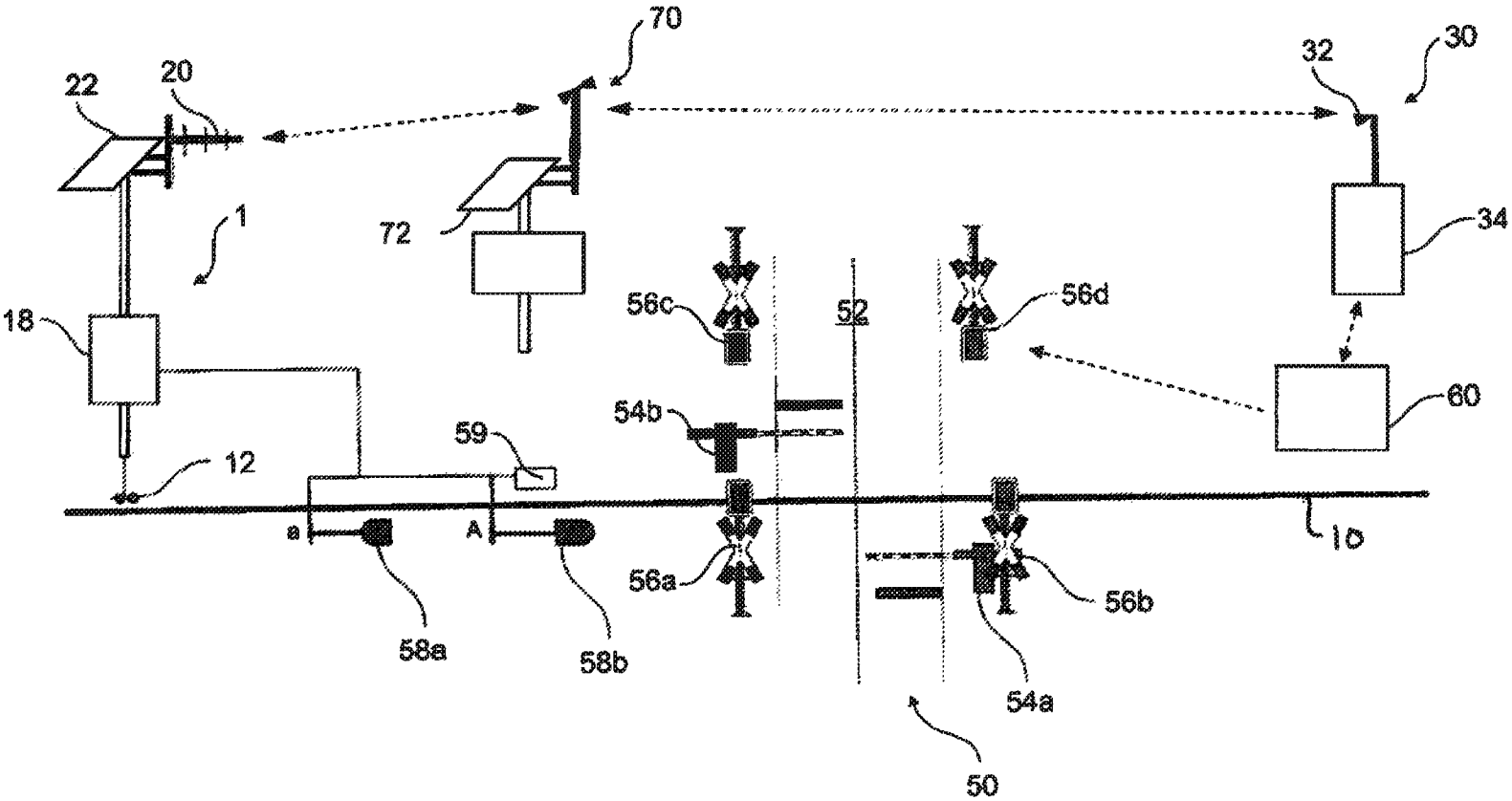
FIG. 2 shows a schematic view of an approach annunciator system.

FIG. 2 shows an approach annunciator system comprising three different components: an approach annunciator 1, a train approach center 30, and an optional signal repeating unit 70. The approach annunciator system in FIG. 2 is explained as an example in connection with a single track.

As already described with respect to FIG. 1, the approach annunciator 1 detects the presence and approach of a train using a rail sensor 12 mounted directly on a rail 10. The approach annunciator 1 may also include an evaluation circuit 27 (see FIG. 5) for determining a train's direction of travel and/or speed. Thus, it may be the case that a train detection is communicated to the control device 26 in the signal switching cabinet 18 only if the train is driving in the direction of a designated level crossing 50. The level crossing 50 has, for each driving direction on a road 52, a half barrier or gate 54*a*, 54*b* and corresponding signal installations 56*a*, 56*b*, 56*c*, 56*d*. The barriers 54*a*, 54*b* and the signal installations 56*a*, 56*b*, 56*c*, 56*d* are controlled by an interlocking 60. The interlocking 60 may be coupled with the train approach center 30, so that in case the train approach center 30 receives a signal that a train is approaching to the level crossing 50, a closing of the barriers 54*a*, 54*b* is triggered and the signal installations 56*a*, 56*b*, 56*c*, 56*d* are lighted.

When the control device 26 in the switching cabinet 18 receives a message from the evaluation circuit 27 of a train driving in direction of the level crossing 50, it creates a "train approaching" message that is sent to the connected transmitting module 24. The transmitting module 24 wirelessly transmits the "train approaching" message to the train approach center 30, using electromagnetic/RF waves generated by the antenna 20. The "train approaching" message may be encrypted using an encryption protocol, for preventing unauthorized reception and/or manipulation of the message. The train approach center 30 is, for example, configurable with software and may receive messages from several approach annunciators. Therefore, the "train approaching" message may be forwarded via potential free contacts to the interlocking 60.

In one embodiment, the control device 26 and/or the evaluation circuit 27 in the approach annunciator 1 determines the speed of a passing train and sends the "train approaching" message depending on the speed of the train.

In difficult topographical conditions or for great distances, one or more signal repeating units 70 may be used, for providing a reliable signal transmission from the approach annunciator 1 to the train approach center 30. Therefore, as shown in FIG. 2, the signal repeating unit 70 may be arranged between the approach annunciator 1 and the train approach center 30 for receiving messages from the approach annunciator 1 and forwarding the messages to the train approach center 30. The signal repeating unit 70 may include also a photovoltaic module 72 that charges a battery in the signal repeating unit 70. The signal repeating unit 70 further includes a transmitting and receiving module for transmitting and receiving the messages. The transmitting power of the transmitting and receiving module may be, depending on the location, adapted in the range of 0.1 to 5 Watts. A maximum distance between the approach annunciator 1 and the train approach center 30 or the signal repeating units 70 depends on the local conditions and obstacles, like houses or trees. In a further embodiment, not only one signal repeating unit 70, but also two or more signal repeating units 70 may be deployed, so that all distances in a potential operational area may be realized without a restriction.

Advantageously, the approach annunciation system with radio transmission of messages is a less expensive solution in relation to a cable-based solution for distances of more than 1000 meters (0.62 miles). Such an approach annunciation system requires little effort for planning and approval and there is no limitation with respect to the territory or the location. Further, there is only a minimal impact on the ongoing rail operation during the installation of such an approach annunciation system, and it may have extremely short execution schedules and, due to the modular assembly, a simple budgeting.

FIG. 2 shows the approach annunciation system as it may be used in a configuration with a single track with an approach annunciation from one side. The system may be used with a track in which trains potentially travel in both directions, or in conjunction with double tracks, by deploying additional equipment similar to that shown in FIG. 2, and/or by augmenting the equipment shown in FIG. 2 (additional sensors, etc.)

In a further embodiment, a time synchronization signal may be sent to several approach annunciators 1 and/or to the signal repeating units 70 every twenty seconds (or another designated time period), for a time synchronization. Hence, a time leveling/equalization between the train approach center 30 and several approach annunciators 1 is assured.

The train approach center 30 may be installed depending on the location and the available cable conductors between the level crossing 50 and the interlocking 60 in the switch house of the level crossing 50 or in the interlocking 60. In one embodiment, all components of the train approach center 30 with exception of the antenna 32 are placed in a switching cabinet 34.

In a further embodiment, a train protection system may be realized with the approach annunciator 1, for example, the approach annunciator acts as an on/off switch of a train protection circuit/system. Between the sensing device/sensor 12 and the level crossing 50, one or more supervision signal installations 58*a*, 58*b* for a vehicle driver may be disposed. The supervision signal installations 58*a*, 58*b* show if the level crossing 50 may be unrestrictedly traversed, i.e., if the level crossing 50 is secured or protected. In the case of a secured level crossing, for example, the barriers 54*a*, 54*b* are closed and the signal installations 56*a*, 56*b*, 56*c*, 56*d* are blinking or illuminated. Additionally, a point-wise train protection system 59 may be installed at the track 10 close to the supervision signal installation 58*a*, 58*b*. The point-wise train protection system 59 may be an oscillating circuit of a predetermined oscillating circuit frequency that is cooperating with a respective system, for example, a sending coil in the train or other rail vehicle. In an embodiment, an automatic stop of the vehicle may be generated if the train protection system 59 is activated and this signals a non-secured or non-protected level crossing. (In other words, if the level crossing is in a non-secured or non-protected state, the train protection system causes the train or other rail vehicle approaching the level crossing to slow or come to a stop before reaching the level crossing.) Thusly, and also in case the vehicle driver is overlooking the supervision signal installation, it is assured that the vehicle does not enter or pass an unsecured level crossing. A point-wise train protection system may be, for example, the Indusi™ system or PZB90.

When the approach annunciator 1 announces to the train approach center 30 an approaching train or other vehicle, the train approach center 30 informs the interlocking 60. The interlocking 60 makes sure that the barriers 54*a*, 54*b* are closed and the signal installations 56*a*, 56*b*, 56*c*, 56*d* are activated. Subsequently, the interlocking 60 receives a feedback that the barriers are closed and that the signaling installation is illuminated. This message is transmitted by the interlocking 60 to the train approach center 30, which in turn transmits a message to the approach annunciator 1 that the level crossing 50 is secured. Subsequently, the approach annunciator 1 deactivates the supervision signal installation 58*a*, 58*b* and the train protection system 59 that was activated before. Therefore, it is guaranteed, that in case of a non-secured level crossing, the train or other vehicle is stopped automatically or by the vehicle driver.

Figure 3:
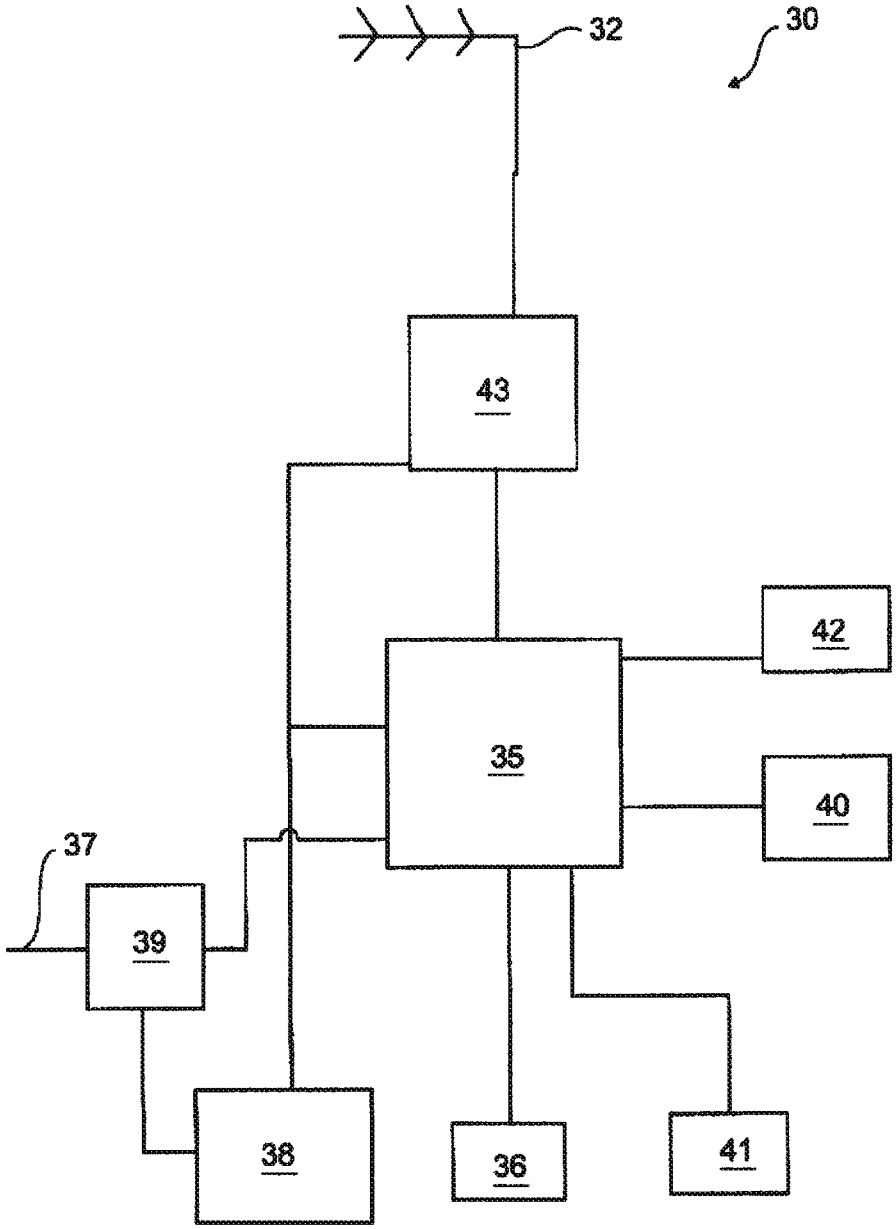
FIG. 3 shows a schematic block diagram of a train approach center.

FIG. 3 shows a schematic block diagram of an embodiment of the train approach center 30. The train approach center 30 comprises an evaluation circuit and/or control unit 35 (with memory 40 and I/O devices 41, 42), a battery 38, a battery charge control unit 39, a radiofrequency (RF) transceiver module 43, and an antenna 32.

If the train approach center 30 receives a "train approaching" message, the evaluation circuit/control unit 35 of the train approach center transmits (via potential free contacts 36) the message (or a related signal/message) to the interlocking 60, which in turn forwards the message (or a related signal/message) to the interlocking technique for activating the level crossing protection system, such as the barriers 54*a*, 54*b* and the signal installations 56*a*, 56*b*, 56*c*, 56*d* (see FIG. 2).

The train approach center 30 obtains electrical energy from a connection to a line supply 37, which may be connected to the electrical energy supply of the level crossing (e.g., 18 to 60 V DC). If necessary, the energy supply may also be effected by a connection to a line supply connected to a 230 V DC or other power grid voltage. For securing the availability of approach annunciation in case of a failure of the 230 V energy supply, a battery 38 may be used for buffering the electrical energy supply. Such a battery 38 ensures a high availability of the complete system. The battery 38 may be dimensioned such that an availability of at least 6 days is possible, i.e., if the line supply 37 is interrupted, the battery has sufficient capacity for powering the train approach center 30 for six days. The battery charge control unit 39 charges the battery 38 using electricity received over the line supply 37, which is connected to the energy supply of the level crossing or to a 230 V DC or other power grid voltage. An absence of reaction on the level crossing/interlocking system may be ensured through a disruptive strength of the battery charge control unit 39 for the battery of the train approach center 30 of 2.1 kV.

The control unit 35 of the train approach center 30 further includes a memory 40, like a flash memory, for the storing of log files. In a specific embodiment, the log files may be read by accessing the memory 40 through a serial interface 41 of the train approach center 30. Also, in a further embodiment, the train approach center 30 may be configured via the serial interface. The train approach center 30 includes one or more LED's 42, in particular color LED's, that give information about the status of the approach annunciation system. Therefore, in a specific embodiment, the train approach center 30 or the train approach annunciation system may include a self diagnostic system that monitors all critical parts of the system, for example the monitoring of the charging current of the approach annunciator 1, of the train approach center 30, and the signal repeating unit 76, and the status of the rail sensors 12 and the like. Thus, an LED may be provided to signal a critical battery status of the approach annunciator 1. This LED is activated when the approach annunciator 1 signals a critical battery status. Naturally, the display may also be realized in another form, for example in a liquid crystal display. Therefore, in the train approach center 30, all messages of the signal components, such as the at least one approach annunciator 1, the train approach center 30, and the at least one signal repeating unit 70, are collected.

As noted above, the train approach center 30 includes an RF transceiver module 43 (transmit and receive module) arranged between the antenna 32 and control unit 35. The RF transceiver module 43 is configured to send and receive wireless messages and signals, e.g., it demodulates electromagnetic waves received by the antenna 32 and provides the demodulated messages to the control unit 35.

Figure 4:
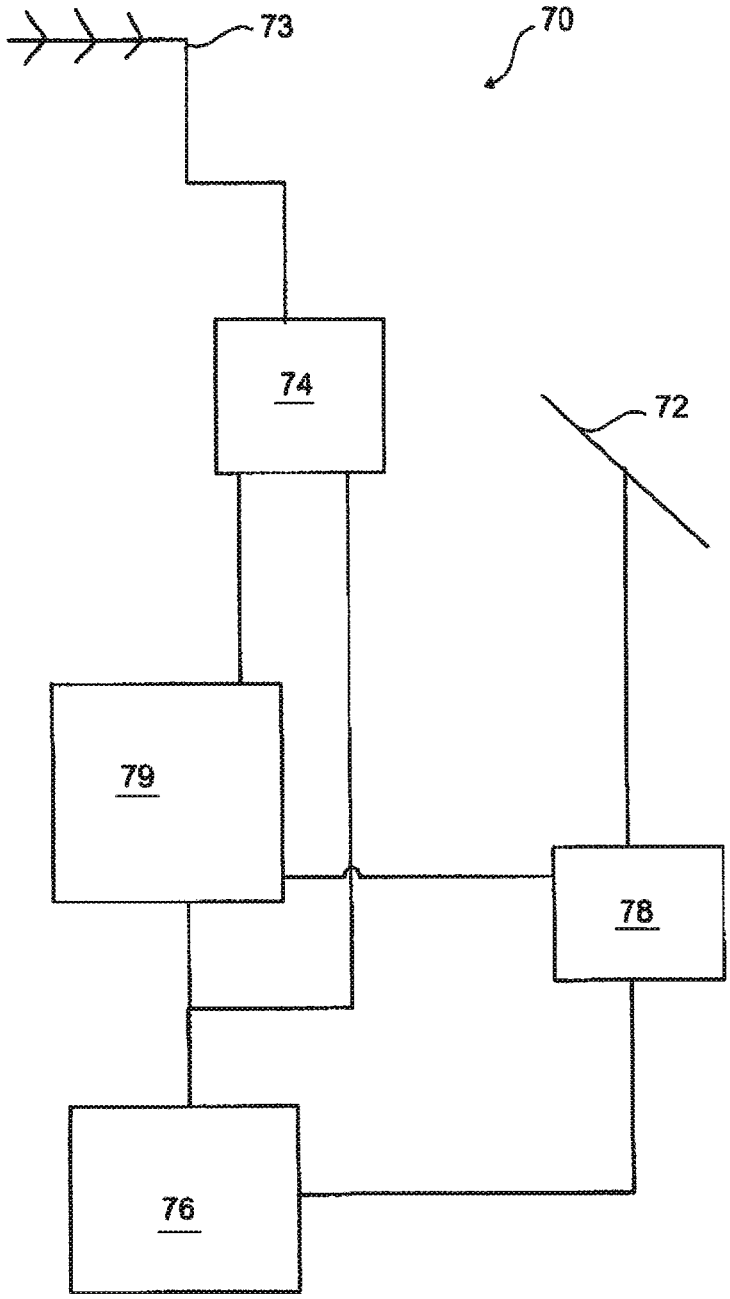
FIG. 4 shows a schematic block diagram of a signal repeating unit.

FIG. 4 shows a schematic drawing of the signal repeating unit 70. The signal repeating unit includes an antenna 73, which is connected electrically with an RF transceiver (transmitting and receiving) module 74. The transceiver module 74 of the signal repeating unit 70 is supplied with energy by a battery 76. The battery 76 may be, for example, charged by a photovoltaic module 72 via a charger (or charge controller) 78. Instead of a photovoltaic module 72, another energy supply may be provided, for example, if a connection to a low voltage grid with 220 V AC exists. A control device 79 in the signal repeating unit 70 processes the messages received by the transceiver module 74 and resends them immediately using the transceiver module 74. As messages are not continuously transmitted, but only in the case of resending a message from the approach annunciator 1 or to the approach annunciator 1, a transmitting unit of the transceiver module 74 may be adjusted into a sleeping mode by the control device 79. Alternatively, if the signal repeating unit 70 has a separate transmitting module or receiving module, the control device 79 may switch off the transmitting module using a transistor, relay, or other switch. In this embodiment, the control unit 79 may switch on the transmitting module only for sending the messages. Thus, high energy savings in the signal repeating unit 70 are possible, so that the autonomous time of the signal repeating unit 70 is drastically raised, for example if the signal repeating unit 70 is powered solely by a battery 76 charged by a photovoltaic module 72. Therefore, the signal repeating unit 70 may be used for difficult topographic terrain. The signal repeating unit 70 may also be used for providing a long distance radio link. For example, the signal repeating unit may be provided with a battery 76 that enables an autonomous time of 31 days.

In FIG. 5 shows a schematic diagram of the approach annunciator 1. The approach annunciator 1 includes a transmitting module/device 24. In another embodiment, the approach annunciator 1 may also include a receiving device that is also connected to the antenna 20 for receiving electromagnetic waves. The transmitting device and receiving device may be an integrated transceiver. In such an embodiment, the radio devices used in the approach annunciator (e.g., the transmitting module 24) are remotely configurable, for example for status messages and a "sign of life," and for working in a bidirectional operation, i.e., transmitting and receiving. As described above, the approach annunciator 1 includes a photovoltaic module 22 that is connected via a charger (or charge controller) 23 to a battery 25, for charging the battery with a current produced by solar energy. The battery supplies the transmitting module 24, the receiving module (if it is present), the control device 26, the sensor control 14, and the evaluation circuit 27. In one embodiment, all components of the approach annunciator 1 work with the same voltage, for example 12 V DC, to prevent energy losses resulting from inefficiencies in voltage transformation.

The control device 26 may control the transmitting module 24 such that the transmitting module 24 may be adjusted into a sleep mode, so that it only consumes very little energy, for example only approximately 5% of the energy of the energy that the transmitting module consumes in its active state. In the sleep mode, all high-energy consumers of the transmitting components are switched off. For example, an amplifier circuit of the transmitting module 24 may be switched off in the sleep mode. Nevertheless, such modules may be supplied with energy that enable a fast wake up of the sensor 12 or a fast wake up of the transmitting module 24 into the operation mode. In another embodiment, the control device 26 may (via a transistor, relay, or other switch) interrupt a current supply of the battery 25 to the transmitting module 24, so that the transmitting module 24 consumes no current at all and therefore extends the life/charge of the battery 25. The various sensors 12, the sensor control 14, and the evaluation circuit 27 may form together a sensing device that transmits a message to the control device 26, if and in which direction and/or at which speed a train is approaching.

For RF communications between the approach annunciator 1, the signal repeating unit 70 (in cases where it is used), and the train approach center 30, an encrypted radio protocol may be used, so that disruption of the transmitted messages or status messages or reprogramming of the train approach center (e.g., through vandalism) may be avoided. When a train or other rail vehicle approaches the level crossing 50, a "train approaching" message is sent by the approach annunciator 1 (or in case another approach annunciator exists, from these) to the train approach center 30.

Additionally, any modules of the train approach annunciation system may be programmed so that they transmit their status, for example the battery status or defects in rail sensors, in predetermined but configurable time intervals to the train approach center 30. For example, the time interval may be between approximately 1 and approximately 60 seconds. If the train approach center 30 does not receive a status message after the predetermined time interval, the train approach center 30 may determine (using its control device) that a communication error or a failure of the specific module, like the approach annunciator 1 or the signal repeating unit 70, exists. This error may be displayed via an error relay, LED, or other display device 42 of the train approach center 30.

In a specific embodiment, the approach annunciator 1, signal repeating unit 70, and train approach center 30 may be used in a master and slave configuration. The master configuration is used preferably for the train approach center 30, whereas the slave configuration is used for the approach annunciator 1.

A Yagi antenna may be used as antenna for the approach annunciator 1 or the signal repeating unit 70. The antenna equipment of the train approach center 30 depends on the place of installation and the configuration of the complete system.

The system described above provides varied application possibilities. The installation of such systems needs less effort compared to the placing of cables. Therefore, the costs may be better calculated. Further application possibilities of an approach annunciator according to the invention may be a train controlled activation of a train platform illumination, positive train control, or for automatic public address announcements for the passing of trains.

Any of the aforementioned systems may be configured to output an error alert in the case of entering a designated error mode, e.g., operational failure. This may comprise illumination of an LED, displaying an error on an LCD display or other display, or transmission of an error code to a remote entity, e.g., control center.

An additional embodiment, similar to those set forth above, relates to a level crossing protection system for a railway. The system comprises at least one operating element 54*a*, 54*b*, 56*a*, 56*b*, 56*c*, and/or 56*d* for controlling road and/or pedestrian traffic at a level crossing 50. The system also comprises a train approach center 30 and a plurality of approach annunciators 1. Each of the approach annunicators is positioned at a different respective location proximate a railway, with the railway extending from the location of the approach annunciator to the level crossing 50. Each of the approach annunciators comprises a sensor 12 for sensing a vehicle traveling along the railway 10, a control device (26 and/or 27) configured to generate a message in response to the sensor 12 sensing a vehicle traveling along the railway, and a transmitting module 24 configured to wirelessly transmit the message to the train approach center 30 or to a repeater module 70 that wirelessly relays the message to the train approach center. The train approach center 30 is configured to control the at least one operating element based on messages received from the plurality of approach annunciators. This may be a direct control, e.g., the train approach center generates signals that are applied to the operating elements for control of the operating elements, or an indirect control, e.g., through an interlocking 60.

According to an aspect of the invention, a "vehicle approaching" or "train approaching" message is a signal containing data/information indicative of a detected vehicle approaching a designated location and/or traveling a designated direction.

Figure 6:
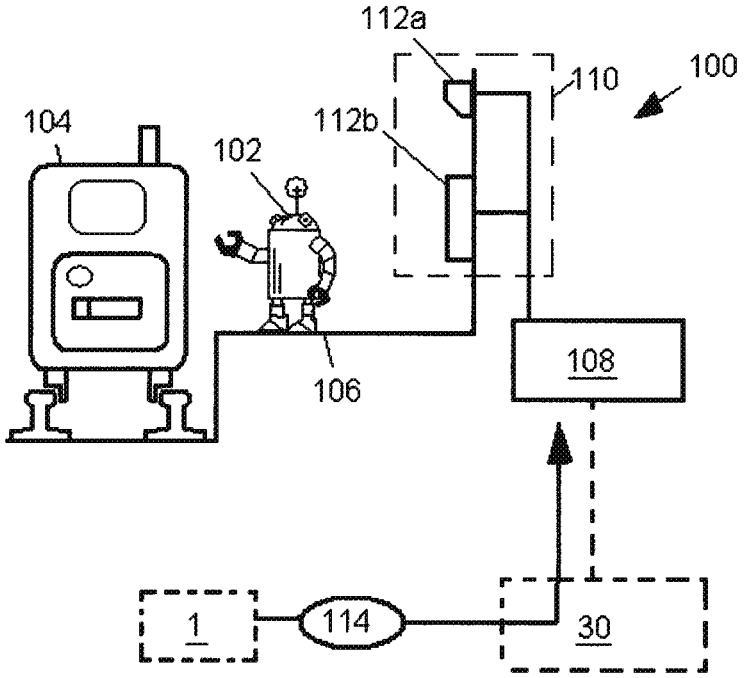
FIG. 6 is a schematic block diagram of a warning system, according to another embodiment.

Another embodiment, with reference to FIG. 6, relates to a warning system 100. The warning system 100 provides an audio, visual, and/or other warning to passengers or other personnel 102 under certain conditions of an approaching vehicle 104. For example, a warning may be provided at least thirty seconds ahead of a vehicle 104 arriving at a loading platform or other loading location 106. (The vehicle 104 may be a rail vehicle or other type of vehicle, such as a bus or other wheeled vehicle.) The warning system 100 includes a warning system control unit 108 and a warning system transducer sub-system 110. The warning system transducer sub-system 110 is electrically coupled to the warning system control unit 108. The warning system transducer sub-system 110 includes one or more warning transducers 112*a*, 112*b*, where by "transducer" it is meant a device that produces a warning for reception by at least certain classes of personnel 102, in response to control signals received from the warning system control unit 108. In an embodiment, the warning system transducer sub-system 110 includes an audio device 112*a* (e.g., speaker or horn) for generating a human-range audible warning and/or a visual device 112*b* (e.g., monitor or other display, selectively illuminated lights or signs) for generating a human-range visual warning.

In operation, the control unit 108 of the warning system 100 receives a "vehicle approaching" message 114 (or a message relating to or resulting from a "vehicle approaching" message), and in response controls one or more of the warning transducers 112*a*, 112*b* to generate a designated warning. For example, the designated warning may be an audible horn sound, and/or an audible recording stating that a vehicle is approaching, and/or a visual warning indicating that a vehicle is approaching, and a visual warning in the form of flashing lights or the like. The warning transducers 112*a*, 112*b* are placed in designated locations, so that when the warnings are generated, they are seen, heard, or otherwise detected by personnel 102 to which the warnings are directed. In a particular example, the warning transducers 112*a*, 112*b* are placed at a passenger loading zone 106, for warning passengers of the pending approach of a train or other passenger-carrying vehicle.

"Vehicle approaching" messages or similar control inputs 114 may be provided to the warning system 100 using any of the approach annunicators 1 and/or train (vehicle) approach centers 30 as described herein. However, the warning system 100 is not limited in this regard, unless otherwise stated, and "vehicle approaching" messages 114 or other control inputs could be generated using other types of equipment. Regardless of the specific vehicle detection equipment used, the vehicle detection equipment (e.g., approach annunicators 1 and/or train/vehicle approach centers 30) is configured for use with the warning system 100 so that "vehicle approaching" messages 114 are provided to the warning system 100 far enough in advance of a detected vehicle 104 reaching a designated location 106 for the warning system 100 to (i) generate a designated warning and (ii) the designated warning is generated at least a designated time period before the vehicle arrives at the designated location 106, and optionally (iii) within a vehicle speed tolerance.

To explain further, assume the warning system 100 has a lag time Y from when it receives an input signal 114 to generating a warning. Denote the designated time period (how far in advance a warning is provided to personnel before a vehicle arrives at a designated location) as X. Then, in an embodiment, the input signal 114 ("vehicle approaching" messages or other control inputs) is provided to the warning system at time X+Y in advance of a vehicle arriving at a designated location 106. In such a case, the input signal 114 may be generated and provided to the warning system 100 when the vehicle in question reaches a distance D before the designated location 106, where D=(V)(X+Y); V=vehicle velocity. If Y is negligible, then D=VX. For example, if it is desired to provide a warning thirty seconds in advance of a rail vehicle reaching a loading platform, and the rail vehicle is traveling at 10 m/s, then an input signal could be generated when the rail vehicle is 300 m from the loading platform. (That is, if the vehicle is traveling at 10 m/s, it will take 30 seconds to traverse 300 meters.) Since vehicles commonly slow before reaching a designated stop location, it may be the case that the warning is generated more than the designated time period X, but this may be acceptable as providing at least thirty seconds warning. Alternatively, vehicle velocity may be determined at multiple points, and an input signal 114 generated based on the vehicle velocity profile.

The vehicle speed tolerance noted above is a speed threshold Vmax of the warning system 100. Here, in an embodiment, the system 100 is configured to generate a warning to meet the designated time period X for all vehicles traveling at or below the threshold Vmax. For example, the threshold may be a maximum expected velocity of vehicles in the transportation system. In one specific example, in the context of a rail system, Vmax is 135 MPH. For meeting the threshold, the system may be configured for detecting the presence of vehicles at a location Dmax away from the designated location 106, where Dmax=(Vmax)(X).

In one embodiment, the warning system 100 (e.g., in conjunction with approach annunciator(s) and other equipment as described herein) is configured to generate warnings to passengers at a loading dock or platform 106 at least thirty seconds before the arrival of any vehicles at the loading platform that are traveling at 135 MPH or slower.

According to one aspect, the warning system 100 is a non-vital system, for providing warnings to personnel while keeping the implementation costs of the system relatively low.

Another embodiment relates to a warning system. The warning system includes an approach annunciator as described herein (e.g., at least one railway vehicle sensor, a control device adapted to receive a first message and to create a second message based on the first message, wherein the first message relates to the at least one railway vehicle sensor sensing a vehicle traveling along the railway, and a transmitting module adapted to send the second message created by the control device), a warning system control unit, and a warning system transducer sub-system electrically connected to the warning system control unit. The warning system transducer sub-system includes at least one warning transducer positioned at a designated location. The at least one warning transducer is configured to generate a warning to personnel at the designated location based upon control signals received from the warning system control unit. The warning system control unit is configured to control the warning system transducer sub-system for the at least one warning transducer to generate the warning upon the warning system control unit receiving (i) the second message from the transmitting module of the approach annunciator or (ii) a message relating to, or derived from, the second message. The second message, and/or message relating to, or derived from, the second message, may be a "vehicle approaching" message.

Another embodiment relates to a warning system. The warning system includes an approach annunciator as described herein (e.g., at least one railway vehicle sensor, a control device adapted to receive a first message and to create a second message based on the first message, wherein the first message relates to the at least one railway vehicle sensor sensing a vehicle traveling along the railway, and a transmitting module adapted to send the second message created by the control device), a warning system control unit, and a warning system transducer sub-system electrically connected to the warning system control unit. The warning system transducer sub-system includes at least one warning transducer positioned at a passenger loading location. The at least one warning transducer is configured to generate an audio and/or visual warning to passengers at the loading location based upon control signals received from the warning system control unit. The warning system control unit is configured to control the warning system transducer sub-system for the at least one warning transducer to generate the warning upon the warning system control unit receiving (i) the second message from the transmitting module of the approach annunciator or (ii) a message relating to, or derived from, the second message, at least thirty seconds before the vehicle arrives at the passenger loading location. The second message, and/or message relating to, or derived from, the second message, is a "vehicle approaching" message.

In another embodiment, each of the plurality of approach annunciators is a stand alone device further comprising at least one battery for providing power to the sensor, control device, and transmitting module, and at least one photovoltaic module for charging the battery. By "stand alone," it is meant that (i) the approach annunciator only communicates wirelessly (i.e., no communication cables) and (ii) the approach annunciator is not connected to an external power source (e.g., public grid or railway) but instead is self-powered through solar power or the like (e.g., fuel powered generator, local wind turbine, mini-hydroelectric station, high capacity battery, or nuclear).

As should be appreciated, the term "message" encompasses both simple binary signals (conveying an "off/on" state of a component, or the like, e.g., "vehicle present" or "vehicle not present") and more complex signals that convey multiple elements of information/data, e.g., encoded messages and signal strings. Additionally, when it is characterized herein that the control device is adapted to receive a first message (from the sensor or sensor sub-system) and to create a second message based on the first message, it may be the case that the second message comprises the first message, e.g., the first message is received at the control device and forwarded to the transmitting module. Alternatively, it may be the case that the first message is a binary signal (sensor output on or sensor output off) that is received at the control device and used as the basis for the control device generating a message for transmission by the transmitting module. Thus, in one embodiment the approach annunciator comprises at least one railway vehicle sensor for sensing a vehicle traveling along the railway, a control device adapted to create a message based on the at least one railway vehicle sensor sensing a vehicle traveling along the railway, and a transmitting module adapted to wirelessly transmit the message created by the control device. ("Wirelessly" refers to transmission from the approach annunciator to a remote entity using RF signals, free space optical communications, or other cable-free transmission means.)

The foregoing has described a system and method for quickly moving a train through a specified location. While specific embodiments of the present invention have been described, it will be apparent to those skilled in the art that various modifications thereto can be made without departing from the spirit and scope of the invention. Accordingly, the foregoing description of the embodiments of the invention and the best mode for practicing the invention are provided for the purpose of illustration only and not for the purpose of limitation.

What is claimed is:

1. An approach annunciator for a railway, comprising:

at least one railway vehicle sensor;

a control device configured to receive a first message and to create a second message based on the first message, wherein the first message relates to the at least one railway vehicle sensor sensing a vehicle traveling along the railway; and a transmitting module configured to send the second message created by the control device;

wherein the control device is configured to operate the transmitting module in an energy saving mode and an operation mode, wherein the transmitting module consumes power at a first rate in the operation mode and at a second rate in the energy saving mode, and wherein the second rate is lower than the first rate and greater than when the transmitter is turned off.

2. The approach annunciator according to claim 1, wherein the transmitting module is configured to send the second message only when the transmitting module is operated in the operation mode.

3. The approach annunciator according to claim 1, wherein the transmitting module is configured to send the second message in the energy saving mode using a lower power and/or with a lower repetition rate than a message sent when the transmitting module is operated in the operation mode.

4. The approach annunciator according to claim 1, wherein in the energy saving mode of the transmitting module, one or more functional components of the transmitting module are switched off.

5. The approach annunciator according to claim 1, further comprising:

an evaluation circuit that is configured to detect a signal of the at least one railway vehicle sensor and to create the first message for the control device;

wherein the evaluation circuit is adapted to determine and to transmit in the first message to the control device the direction and/or the velocity of the vehicle traveling along the railway.

6. The approach annunciator according to claim 1, wherein the control device is configured to change the transmitting module to the energy saving mode after the sending of the second message.

7. The approach annunciator according to claim 1, wherein the approach annunciator comprises a battery that provides energy to the railway vehicle sensor, the control device, and/or the transmitting module.

8. The approach annunciator according to claim 7, wherein the approach annunciator comprises a photovoltaic device for charging the battery.

9. An approach annunciator system for a train comprising:

an approach annunciator according to claim 1; and a train approach center configured to receive the second message sent by the transmitting module.

10. A level crossing protection system comprising:

at least one operating element for controlling road and/or pedestrian traffic at a level crossing; and an approach annunciator system according to claim 9, wherein the train approach center is configured to control the at least one operating element based at least in part on the second message received by the train approach center from the transmitting module.

11. The level crossing protection system according to claim 10, wherein the train approach center is configured to receive a status report of the at least one operating element.

12. The level crossing protection system according to claim 11 wherein the approach annunciator is configured to control a control system for the vehicle, wherein the control system is positioned close to or at the rail between the sensor and the level crossing.

13. The approach annunciator according to claim 1, wherein the energy saving mode is a sleep mode where the transmitting module consumes between approximately 1% and approximately 50% of the energy consumed by the transmitting mode when operated in the operation mode.

14. A warning system comprising:

an approach annunciator according to claim 1;

a warning system control unit; and a warning system transducer sub-system electrically connected to the warning system control unit, wherein the warning system transducer sub-system comprises at least one warning transducer positioned at a designated location, the at least one warning transducer configured to generate a warning to personnel at the designated location based upon control signals received from the warning system control unit;

wherein the warning system control unit is configured to control the warning system transducer sub-system for the at least one warning transducer to generate the warning upon the warning system control unit receiving the second message from the transmitting module of the approach annunciator or a message relating to, or derived from, the second message.

15. A method for annunciating an approaching vehicle on a railway, the method comprising:

receiving a first message at a control device portion of an approach annunciator, the approach annunciator comprising the control device, a railway vehicle sensor, and a transmitting module, wherein the first message relates to a vehicle sensed on the railway by the sensor;

in response the receiving the first message, creating a second message by the control device; and sending the second message by the transmitting module;

wherein the transmitting module is operated in an energy saving mode and an operation mode, wherein the transmitting module consumes power at a first rate in the operation mode and at a second rate in the energy saving mode, and wherein the second rate is lower than the first rate and greater than when the transmitter is turned off.

16. The method according to claim 15, wherein the transmitting module is changed from the energy saving mode to the operation mode before the sending of the second message, and wherein the transmitting module is changed back from the operation mode to the energy saving mode after the sending of the second message.

17. The method according to claim 15, wherein the second message is sent in the energy saving mode using less power and/or fewer repetitions than messages sent by the transmitting module when operating in the operation mode.

18. The method according to claim 15, wherein the energy saving mode is a sleep mode where the transmitting module consumes between approximately 1% and approximately 50% of the energy consumed by the transmitting module when operating in the operation mode.

19. The method according to claim 18, wherein in the sleep mode of the transmitting module, one or more functional components of the transmitting module are switched off.

20. A level crossing protection system comprising:

at least one operating element for controlling road and/or pedestrian traffic at a level crossing;

a train approach center; and a plurality of approach annunciators, wherein each of the approach annunciators is positioned at a different respective location proximate a railway, said railway extending from the location of the approach annunciator to the level crossing, and wherein each of the approach annunciators comprises a sensor for sensing a vehicle traveling along the railway, a control device configured to generate a message in response to the sensor sensing a vehicle traveling along the railway, and a transmitting module configured to wirelessly transmit the message to the train approach center through a repeater module that wirelessly relays the message to the train approach center, wherein the train approach center is configured to control the at least one operating element based on messages received from the plurality of approach annunciators.

21. The level crossing protection system of claim 20 wherein each approach annunciator is a standalone device further comprising at least one battery for providing power to the sensor, control device, and transmitting module, and at least one photovoltaic module for charging the battery.

22. An approach annunciator for a railway, comprising:

at least one railway vehicle sensor for sensing a vehicle traveling along the railway;

a control device configured to create a message based on the at least one railway vehicle sensor sensing a vehicle traveling along the railway; and a transmitting module configured to wirelessly transmit the message created by the control device;

wherein the control device is configured to operate the transmitting module in an operation mode for wirelessly transmitting the message created by the control device, and in an energy saving mode otherwise, wherein the transmitting module consumes less power when operating in the energy saving mode than when operating in the operation mode.

23. The approach annunciator of claim 22 wherein the approach annunciator is a standalone device further comprising at least one battery for providing power to the sensor, control device, and transmitting module, and at least one photovoltaic module for charging the battery.

* * * * *

UNITED STATES PATENT AND TRADEMARK OFFICE

CERTIFICATE OF CORRECTION

PATENT NO. : 8,469,319 B2
APPLICATION NO. : 12/852073
DATED : June 25, 2013
INVENTOR(S) : Kiss, Jr. et al.

It is certified that error appears in the above-identified patent and that said Letters Patent is hereby corrected as shown below:

In the Specification:

In Column 2, Line 16, delete "element in" and insert -- element is --, therefor.

In Column 13, Lines 34-35, delete "annunicators" and insert -- annunciators --, therefor.

In Column 14, Line 33, delete "annunicators" and insert -- annunciators --, therefor.

In Column 14, Line 39, delete "annunicators" and insert -- annunciators --, therefor.

Signed and Sealed this
Twenty-fourth Day of September, 2013

Teresa Stanek Rea
*Deputy Director of the United States Patent and Trademark Office*